US005377461A

United States Patent [19]

DeGrada et al.

[11] Patent Number: 5,377,461

[45] Date of Patent: Jan. 3, 1995

[54] STRUCTURE FOR THE CREATION OF ROOM DIVIDING WALLS PARTICULARLY FOR OPERATING THEATRES AND THE LIKE

[75] Inventors: Bruno DeGrada; Guido Ortolani, both of Turate, Italy

[73] Assignees: Cogefar-Impresit Costruzioni Generali S.p.A.; Omasa S.r.l., both of Italy

[21] Appl. No.: 11,368

[22] Filed: Jan. 29, 1993

[30] Foreign Application Priority Data

Feb. 11, 1992 [IT] Italy ..... MI92A 000275

[51] Int. Cl.[6] ..... E04B 2/00

[52] U.S. Cl. ..... 52/126.4; 52/241; 52/126.1; 52/238.1; 52/506.06; 52/483.1

[58] Field of Search ..... 52/241, 126.4, 126.2, 52/475.1, 476, 238.1, 239, 506.06, 775, 483.1

[56] References Cited

U.S. PATENT DOCUMENTS

| | | | |
|---|---|---|---|
| 1,990,259 | 7/1932 | Walters . | |
| 2,969,565 | 1/1961 | Levy | 52/126.4 |
| 3,216,166 | 11/1965 | Brown | 52/483.1 |
| 3,411,252 | 11/1968 | Boyle, Jr. | 52/126.4 |
| 3,551,584 | 12/1970 | Rose | 52/126.2 |
| 3,852,927 | 12/1974 | Birum . | |
| 4,060,025 | 11/1977 | Pelosi, Jr. | 52/506.06 |
| 4,064,664 | 12/1977 | Gaul | 52/483.1 |
| 4,553,365 | 11/1985 | Bechstein | 52/506.06 |
| 4,596,098 | 6/1986 | Finkbeiner et al. | 52/241 |
| 4,918,886 | 4/1990 | Benoit et al. | 52/126.2 |
| 5,020,290 | 6/1991 | Hajjar | 52/241 |
| 5,040,345 | 8/1991 | Gilmour | 52/241 |
| 5,062,246 | 11/1991 | Sykes | 52/126.4 |
| 5,155,955 | 10/1992 | Ball et al. | 52/126.4 |
| 5,228,254 | 7/1993 | Honeycutt et al. | 52/241 |
| 5,245,811 | 9/1993 | Knorr | 52/238.1 |
| 5,285,602 | 2/1994 | Felton | 52/238.1 |

FOREIGN PATENT DOCUMENTS

| | | |
|---|---|---|
| 2259951 | 8/1975 | France . |
| 6921764 | 5/1969 | Germany . |
| 2320592 | 10/1974 | Germany . |
| 2439167 | 2/1976 | Germany . |
| 2552827 | 10/1976 | Germany . |

*Primary Examiner*—Carl D. Friedman
*Assistant Examiner*—Wynn E. Wood
*Attorney, Agent, or Firm*—Ladas & Parry

[57] ABSTRACT

A structure for the creation of room dividing walls or for the lining of pre-existing walls, particularly for operating theatres and the like, comprising upright members (2), independent of one another, each made integral with the ceiling and the floor by appropriate means of anchoring (3, 4), equipped with means of height adjustment (4), to such uprights there being made integral stiffening cross members (5) and front lining panels (6, 206) adjacent to one another, there being furthermore provided means (7) for centering and means (8) for fixing such panels to uprights (2) as well as sealing members (15) for spaces (206*a*) made in the thickness of panels (206) to accommodate service equipment.

9 Claims, 5 Drawing Sheets

Figure 1:
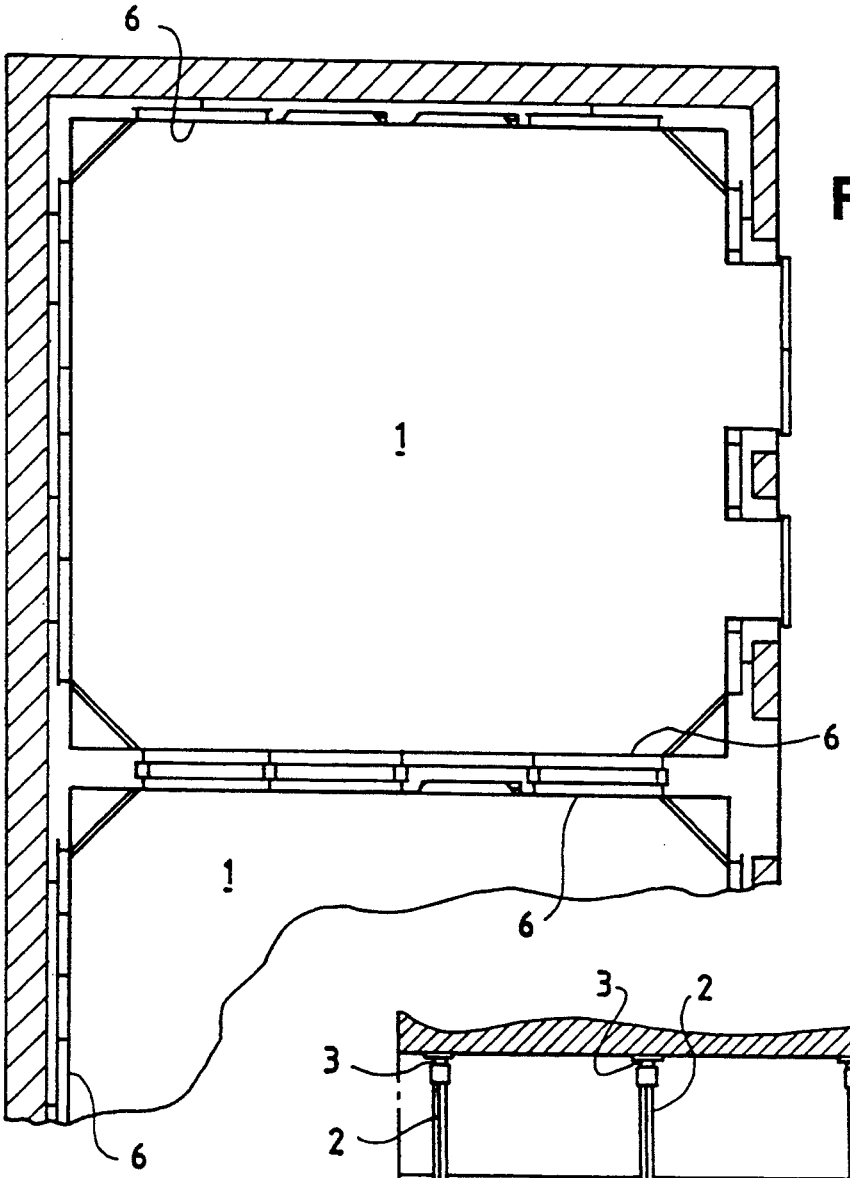

Fig 5
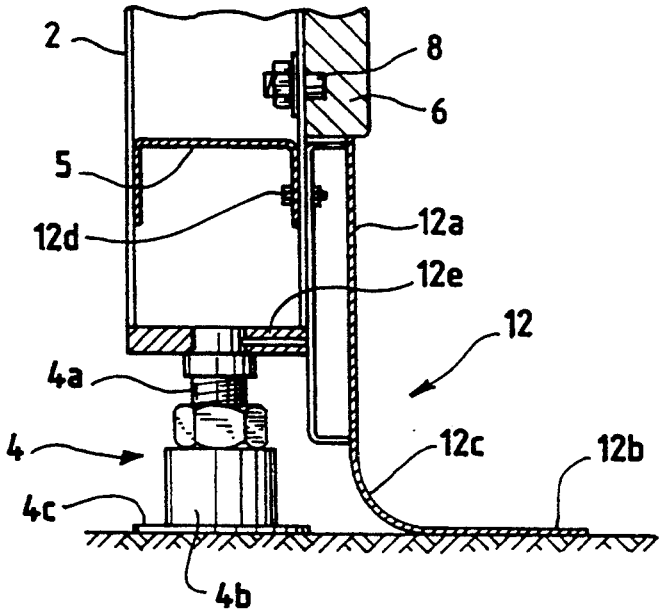
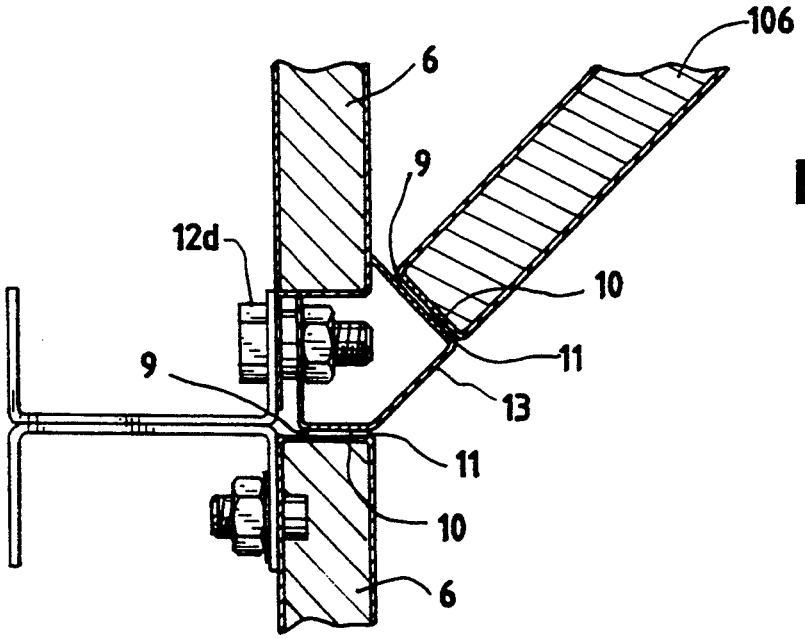
Fig. 6
Fig. 7
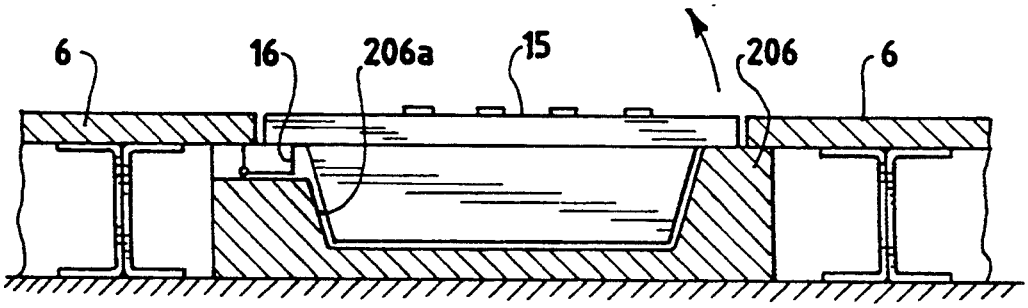

STRUCTURE FOR THE CREATION OF ROOM DIVIDING WALLS PARTICULARLY FOR OPERATING THEATRES AND THE LIKE

The object of this invention is a structure for the formation and lining of walls and the like for rooms such as operating theatres, outpatient departments and the like in which there is required complete isolation from external contaminating agents and the maintenance of specific internal conditions.

It is known that in operating theatres, outpatient departments and the like, where it is necessary to perform operations under optimum hygienic conditions, there is posed the problem of containing the level of bacterial contamination as much as possible. In particular there is felt the need to obtain rooms whose fixed structures, which cannot be periodically made sterile with the normal techniques used for small utensils, prove the most suitable possible for achieving minimum conditions of build-up of dirt and of occurrence of bacteria.

Furthermore, when it becomes necessary to create more operating theatres intended for surgical operations of different medical specializations, it is necessary to be able to provide rooms of dimensions suited to each particular requirement; for example it is known that operations of ophthalmological type require fairly small operating theatres, whereas on the other hand in the orthopaedic field much larger sizes are required.

There is therefore posed the technical problem of providing structures capable of being advantageously used in rooms which require particular conditions of hygiene while at the same time ensuring ease of assembly, modular application, limited weight and dimensions and undergoing little deterioration as a result of the frequent washing operations required by the particular room to which they are applied.

Such problems are resolved by a structure according to this invention, which comprises a structure for the creation of room dividing walls or for the lining of pre-existing walls for operating theatres and the like comprising upright members, independent of one another, each made integral with the ceiling and the floor by appropriate means of anchoring, equipped with means of height adjustment, to such uprights there being made integral stiffening cross members and front lining panels adjacent to one another, there being furthermore provided means for centering and means for fixing such panels to the uprights as well as space sealing members made in the thickness of panels (206) and of the double ceiling cavity to accommodate service equipment.

More particularly, the structure according to the invention provides that such uprights consist of two "C" sections set against one another, on each wing of which are provided such means of centering and means of fixing, and that such means of upper anchoring consist of fixed flanges made integral with the ceiling of the room and such means of lower adjustment consist of screw and nut fasteners located between the lower end of the upright and a floor support member made of friction material to prevent any shifting of the upright from the position of vertical alignment.

According to the invention, provision is also made for such panels to consist of a surrounding frame to which is applied a front sealing plate, such frame having a substantially "U" section on the rear surface of which are provided seats for centering and connection to appropriate means of restraint, preferably consisting of means of reversible elastic deformation capable of becoming deformed during the passage of such corresponding seats provided on the rear surfaces of the frame of such panels and to recover their initial setting following the passage of such seats, thus achieving the mechanical restraint of the said panels.

The structure according to this invention provides moreover that such front panels have a space provided within their thickness, capable of containing the thickness of a corresponding panel made integral with the structure by means of a concealed hinge and capable of accommodating within the interior thereof service equipment, and that such panels are applied transversally between two corner panels via corresponding means of anchoring shaped in such a way as to make parallel all the adjacent surfaces of the aligned and inclined panels.

Figure 2:
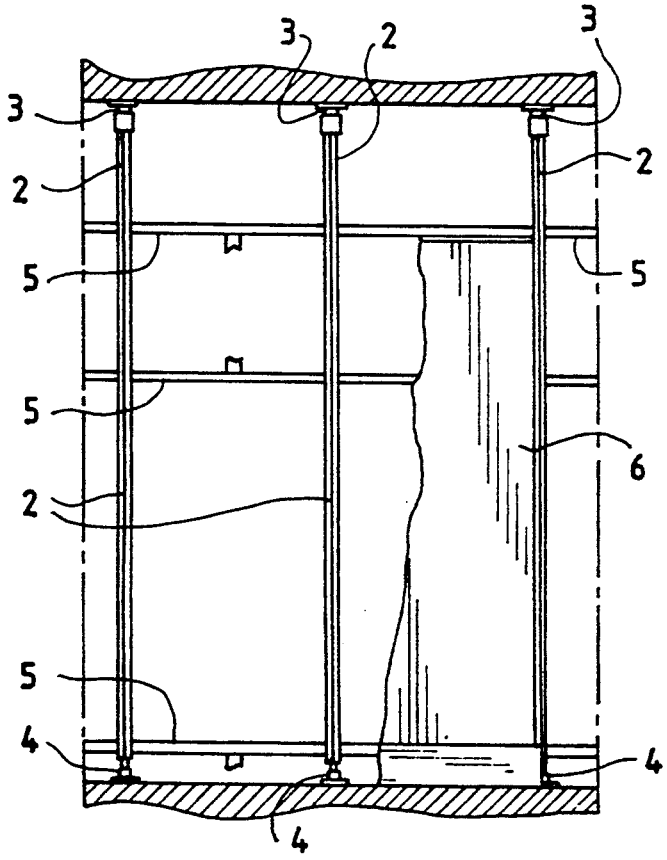
Figure 3:
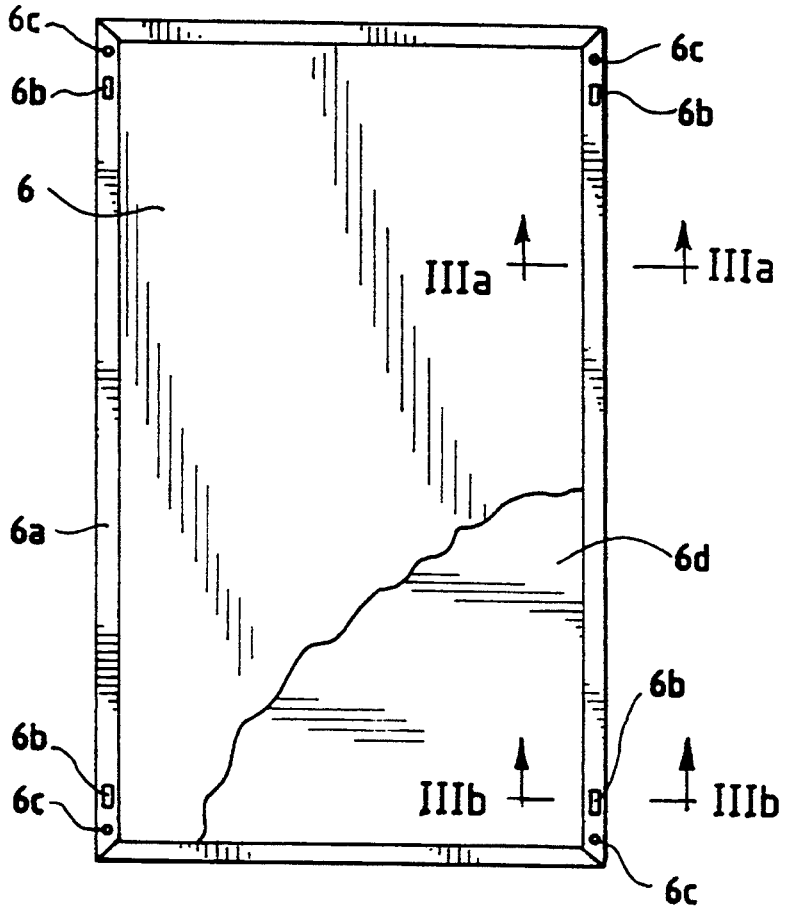
Figure 3A:
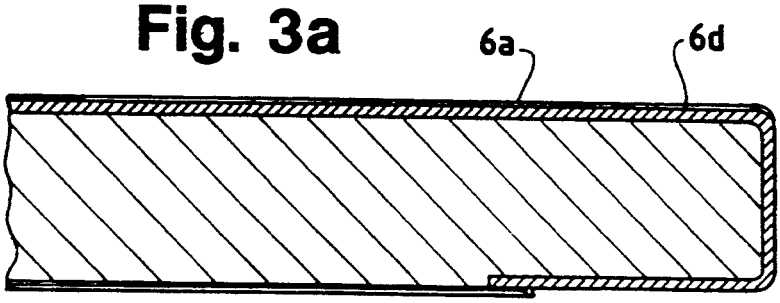
Figure 3B:
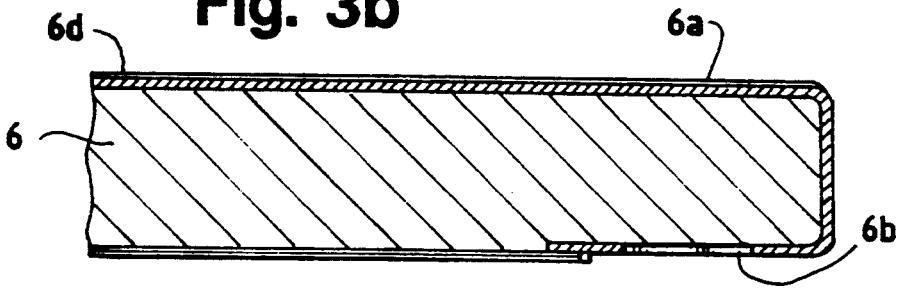
Figure 4A:
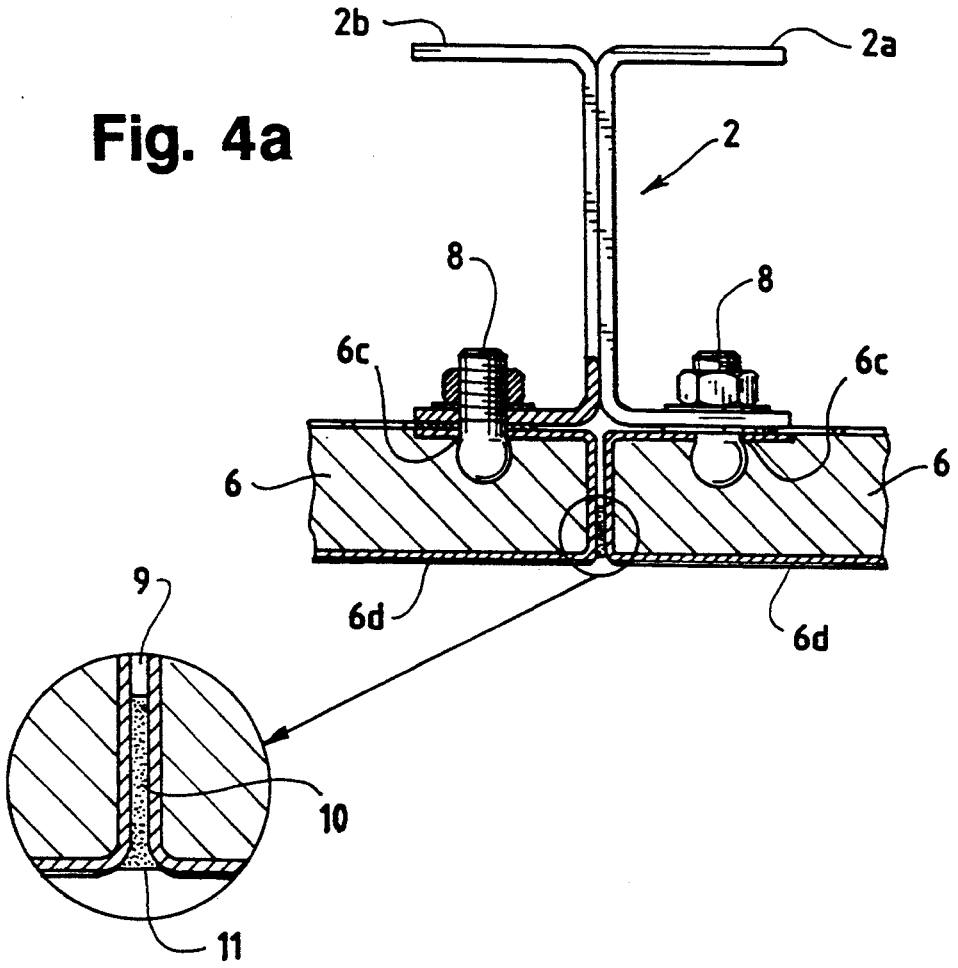
Figure 4B:
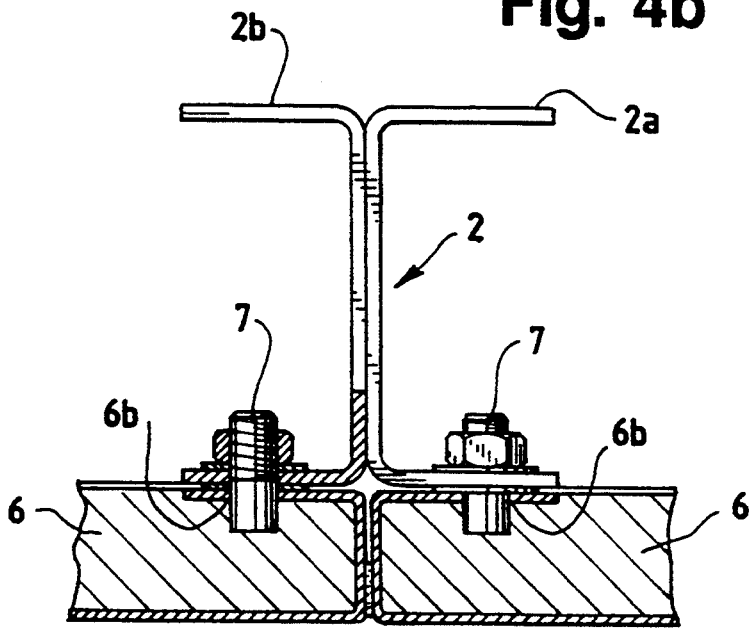
Figure 8:
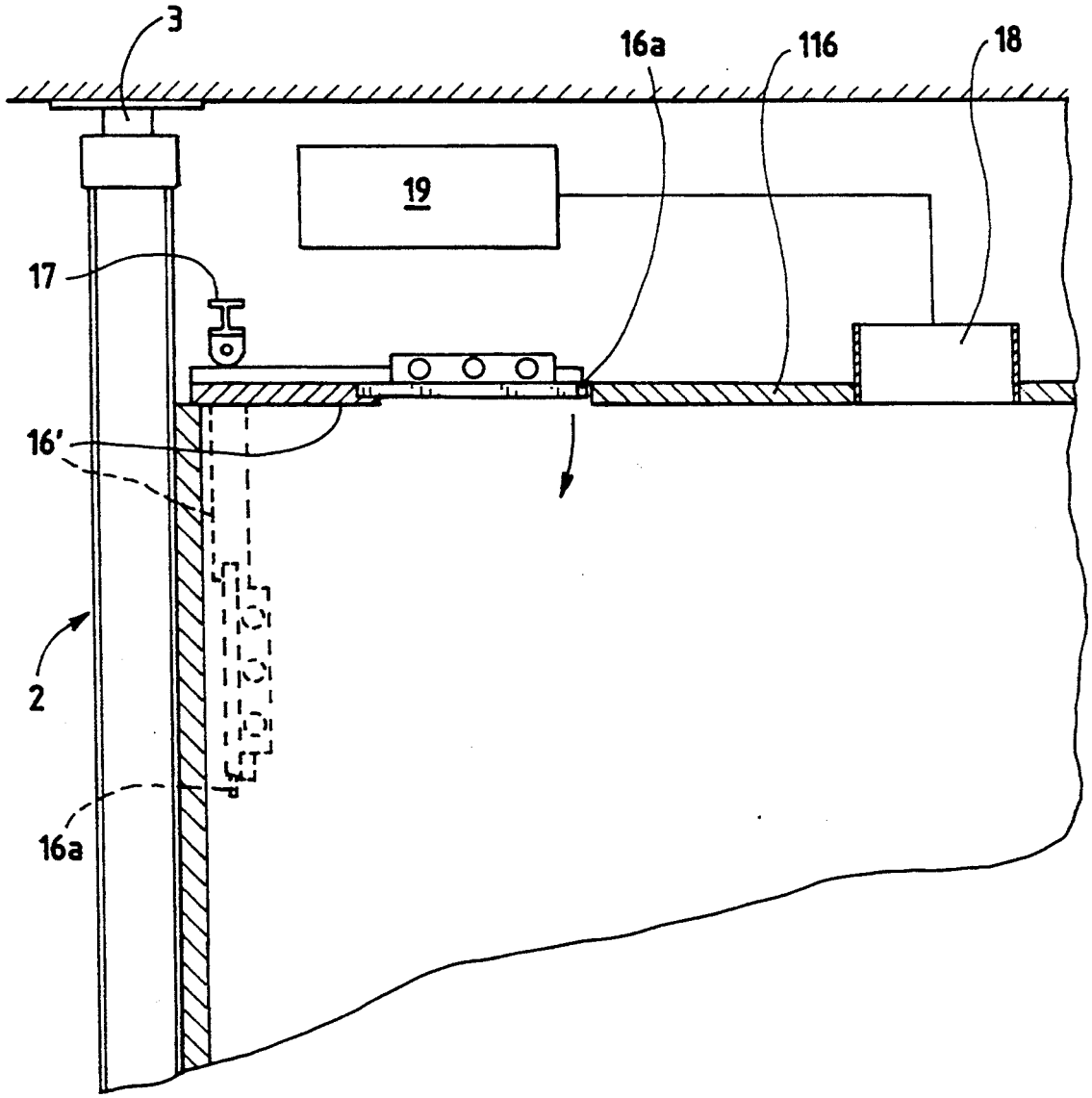

Further details and features may be obtained from the following description given with reference to the attached drawings, which show:

In FIG. 1: a plan view of an operating theatre created by means of the structure according to the invention, In FIG. 2: a front view of a wall formed with the structure according to the invention, In FIG. 3: a plan view of a panel according to the invention, In FIG. 3*a*: a section of the panel according to plotting plane IIIA—IIIA of FIG. 3, In FIG. 3*b*: a section of the panel according to plotting plane IIIB—IIIB of FIG. 3, In FIG. 4*a*: a partial schematic section of the assembled structure, seen in relation to the flexible coupling member, In FIG. 4*b*: a like section seen in relation to the centering pin, In FIG. 5: a partial section showing the detail of the base of an upright and of the finish with skirting board, In FIG. 6: a cross-section showing the detail of the finishing components for the corners of the room, In FIG. 7: the detail of an equipment-carrying door according to the invention, In FIG. 8: a schematic section of the double ceiling achieved by means of the structure according to this invention.

As shown in FIG. 1, one or more operating theatres 1 may be created by means of the structure according to the invention, which substantially comprises (FIG. 2) a multiplicity of uprights 2 substantially consisting of two members 2*a* and 2*b* of "C" section set against one another and made integral using means which are self-evident and not illustrated.

Such uprights 2 are attached at the top to the ceiling of the room by means of flanges 3 and appropriate means of fixing, not illustrated, while at the lower end, to be attached to the floor, they have a supporting foot 4 adjustable for height by means of screw and nut fasteners 4*a* (FIG. 5) located between upright 2 and a floor support pad 4*b* equipped with means of friction 4*c* capable of preventing shifting of the floor base from the axis of vertical alignment.

Such uprights 2 are furthermore connected to one another by a multiplicity of beams 5 together with which they form a rigid reticular structure capable of supporting panels 6 which are made integral with uprights 2 and beams 5 as will be more clearly described hereinafter. As shown in FIGS. 4*a* and 4*b*, on the inward-facing wings of "C" uprights 2 openings are provided in which are inserted centering pins 7 and flexible restraining members 8 for attaching panel 6. As shown in FIG. 3, this mounting arrangement consists of a surrounding frame 6*a* of U section in which are provided slots 6*b* and holes 6*c* respectively for connection to said pins 7 and to said flexible restraining members 8. Referring to FIG. 3*a*, there is superimposed on such surrounding frame 6*a* a flat member 6*d* of thin section with a glazed surface to withstand the action of the products used for washing the surfaces. By means of the structure as described, assembly of the panels is very simple and quick; thus, after placing in alignment and applying the first panel 6 to one of sections 2*a* of uprights 2, by connecting the appropriate pin 7 with the centering slot 6*b* and flexible member 8 to affixing hole 6*c*, all the subsequent panels can be placed in position using the previous panel as a "template" for the next one which, on being placed adjacently to such previous panel, is secured to the two sections, respectively second 2*b* and first 2*a*, of two subsequent uprights 2. Since, however, interstices 9 formed by the positioning of further panels 6 could become points of accumulation of dust and therefore of generation of bacteria, they are filled with packing material 10, for example of silicone type with subsequent surface finish 11 using epoxy paint; in this way the surface finish of the entire wall is devoid of points of accumulation of dirt and therefore of bacterial contamination as required to ensure the hygienic conditions envisaged for the purpose for which such rooms are intended.

The structure according to the invention provides in addition certain features for the completion of particular parts of the room; for example the lower strip of the walls in the vicinity of the floor (FIG. 5) is completed by means of a skirting 12, formed by two edgepieces 12*a* and 12*b* joined to one another by a convex bend 12*c*, made integral with uprights 2 by means of screw and nut fasteners 12*d* of known type as illustrated in FIG. 5, after which such skirting 12 is applied in the correct position by means of centring pins 12*e*.

A further finishing feature consists of a counterpanel 106 located at an angle of, say, 45° in relation to the corners of the room in order to provide better forced air circulation by means of appropriate conditioning equipment; in this case provision is made for applying a connecting member 13 located between two panels 6, one of which forms the angle (FIG. 6); such connecting member 13 is made integral with such panel 6 by means of screw and nut fasteners 12*d* and is shaped in such a way as to present surfaces adjacent to the various panels 6 and 106 in order to form therewith interstices 9 set closely like those existing between the adjacent panels and capable like these of being filled with sealant 10 with final smooth paint finish 11; there are therefore also prevented in this case any potential points of accumulation of dust and the like.

As shown in FIGS. 1 and 7, a further object of this invention is a panel 206, like base panels 6, which has in its thickness a recess 206*a* capable of accommodating the full thickness of a door 15 made integral with panel 206 by means of a concealed hinge 16 which makes possible in one sense the complete moving away of door 15 from space 206*a* which therefore becomes accessible for cleaning operations, for example by means of air or fluid Jets, and in the opposite sense the accommodation of the thickness of the said door so that once closed it is again aligned with adjacent panels 6.

The space provided in panel 206 is further protected by means of a casing which isolates the said panel from the interior of the operating theatre.

As shown in FIG. 8 a further feature of the structure according to the invention is the provision of a double ceiling which is provided by means of panels 16' hinged to a double "C" cross member 17 set alternately as required in relation to fixed panels 116, each surrounding edge of the moving and fixed panels being associated with a sealing section 16*a* which makes it possible to prevent the passage both of air and of dust and the like.

To hinged panels 16' there may be applied electrical devices such as lamps and the like, while to fixed panels 116 there are applied apertures 18 for the outflow of conditioned air generated by appropriate equipment 19 located in the cavity of the double ceiling.

We claim:

1. A structure for the creation of room dividing walls or for the lining of pre-existing walls, particularly for operating theatres and the like, said structure comprising a plurality of uprights, each upright comprising two C-shaped sections set against one another and having oppositely directed wings, means for anchoring said uprights, respectively, to the ceiling and the floor of a room being partitioned, said anchoring means including means for adjusting the height of said uprights, stiffening cross beams connecting, respectively, adjacent ones of said uprights, front lining panels arranged adjacent to one another and against said connected uprights, and means for securing adjacent ones of a pair of said panels to the adjacent wings of said uprights including centering means for centering panels with respect to said uprights and affixing means affixing said panels to said uprights, said centering means being separate from said affixing means and both said centering and said affixing means being attached to said C-shaped section, said lining panels having provided therein centering slots and affixing holes for connection, respectively, to said centering means and said affixing means, said affixing means including reversible elastic restraining members capable of being deformed upon passing through said affixing holes, the affixing means securing the lining panels to the C-shaped sections.

2. The structure of claim 1, wherein at least one of said panels is a service panel including a cavity for accommodating service equipment, and a door panel hinged to the service panel for covering said cavity.

3. The structure of claim 1, wherein said anchoring means include fixed flanges for connecting an upper end of each of said uprights to the ceiling, and fasteners provided between a lower end of each of said uprights and corresponding ones of a number of floor support pads, said floor support pads having means made of friction material to impede any shifting of the upright from a vertical alignment position, said height adjustment means comprising a nut-screw fastener assembly.

4. The structure of claim 1, wherein each of said front lining panels includes a surrounding frame covered by a front sealing panel, said surrounding frame having a substantially U-shaped rear section on which are provided said centering slots and said affixing holes for connection respectively to said centering means and said affixing means.

5. The structure of claim 4, wherein said affixing means on said surrounding frame recovers their initial shape after passing through the affixing holes, thereby achieving a mechanical restraint of said panels to said uprights.

6. The structure of claim 2, wherein said service panel has a thickness corresponding to the thickness of said door panel, said door panel being connected to said service panel through a concealed hinge and defining an interior space for accommodating the service equipment there within.

7. The structure of claim 1, wherein two corner panels of said front lining panels are connected through angular connecting means shaped to enable any desired angular connection between said two corner panels.

8. The structure of claim 1, wherein interstices between any pair of said adjacent front lining panels are filled with sealants of silicone or the like and are provided with a surface coating of finishing paint.

9. The structure of claim 1, further comprising fixed ceiling panels mounted to a fixed support structure in spaced relation to the ceiling, and at least one moveable ceiling panel hinged to said structure to cover an opening for housing service equipment defined by said fixed ceiling panels.

* * * * *